US005649629A

United States Patent [19]

Kennedy, Jr.

[11] Patent Number: 5,649,629

[45] Date of Patent: Jul. 22, 1997

[54] TWO TIER OFFSET GATE

[76] Inventor: John B. Kennedy, Jr., 4731 Knollwood Dr., Tallahassee, Fla. 32303

[21] Appl. No.: 456,111

[22] Filed: May 31, 1995

[51] Int. Cl.[6] ..... B07C 9/00

[52] U.S. Cl. ..... 209/657; 209/656; 209/900; 271/305; 271/303

[58] Field of Search ..... 209/657, 656, 209/900; 271/305, 303; 198/367, 367.1

[56] References Cited

U.S. PATENT DOCUMENTS 4,047,712 9/1977 Burkhardt et al. ..... 271/305
5,340,099 8/1994 Romanenko et al. ..... 271/305 X

*Primary Examiner*—David H. Bollinger
*Attorney, Agent, or Firm*—Carnes, Cona, and Dixon

[57] ABSTRACT

The present invention provides for a two tier gate device that is adapted to be removably secured to an existing mail sorting machine. The two tier gate device of the present invention includes a first gate and a second gate. The first gate is secured to the conventional mail sorting machine while the second tier is attached to the first tier so that the front end of the second gate is co-planar with the first tier while the second end of the second tier is off-set with the first tier. By providing for this design and configuration, the two tier gate device of the present invention will prevent flats, large letters, magazines, catalogs, or other various documents from turning sideways, rolling up, and to eventually jam the machine, while still enabling the pusher finer on the conventional machine to pass the gate device without interference.

6 Claims, 5 Drawing Sheets

TWO TIER OFFSET GATE

BACKGROUND OF THE INVENTION

1. Field of the Invention

The present invention relates generally to a mail gate extension device to aid in the mechanical sorting of flats, large letters, magazines, catalogs, or the like, and more particularly to a device that will prevent these items from jamming as these items turn the bend of the machine's belt circular pathway in the letter sorting machine.

2. Description of the Prior Art

For many years the Post Office and other entities have used mechanical letter and flat sorters to sort large volumes of mail. These mail sorters, in particular the Multiple Position Flat Sorting Machine (MPFSM) 775 or 881, consist of a belt which carries flats, large letters, magazines, catalogues, and other documents past a number of bins. Each bin designates a specific location for the items. To assist in the sorting process there are a number of gates, a gate being situated for each bin. The gates route the item by permitting the item to pass by all bins, until a designated gate forces the item into a selected bin. Unfortunately, as the items proceeds past the bins many of the flimsy items tend to either roll up or lean over and become perpendicularly located (turn sideways). As the belt proceed it loops to form an elongated circular pathway. On the turn-end or end of this pathway many of the flimsy items which have become perpendicularly located (turned sideways) jam on the pusher fingers that push the item s around the belt. In the past attempts have been made to avoid this problem though the addition of deflectors, the initial design of the machine, modifications to the belts and gates, and/or other various changes. However these attempts have met with minimal success.

Although there have been many inventions related to mechanical mail and document sorting machines, none of the previous machines address the problem of flats jamming the machine by adapting or modifying the existing machine. These prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention, the two tier offset gate provides an apparatus that is adapted to be removably secured to any conventional mail sorting machine. The two tier offset gate of the present invention provides for a gate which will prevent flats, large letters, magazines, catalogs, or other like documents from rolling up, jamming or becoming perpendicularly located (turning sideways) while the items proceed around the turn-end in the machine belt's pathway. This will provide positive gating without slidebys, missorting, or roll ups which cause track jams.

The two tier offset gate of the present invention is uni-body and is constructed from rigid material. This device is adapted to be removably secured to the existing or conventional mail sorting machine that is presently utilized.

The gate of the present invention includes a first portion, a second portion, and a third portion. The first portion is a vertical blade or first tier that is adapted to be removably secured to an existing machine via an attaching means. This first portion further includes a front side and a back side. At the bottom of this first portion and extending outwardly from the side of the first portion is the second portion. This second portion is a spacer. The spacer includes a front end and a back end. The back end extends further outwardly from the first portion than the front end, hence providing a somewhat triangular shape for the spacer. Attached to the opposite side of the spacer is the third portion.

This third portion includes a shaft that extends upwardly from the spacer. This shaft has a first end and a second end. Secured to the first end is an extension that is attached to the spacer to provide for the entire length of the extension to be attached to the side of the spacer. The second end of the shaft is attached to a second blade or second tier. This second blade or second tier, which includes a front end and a back end, extends horizontally and outwardly from the second end of the shaft. Due to the shape of the spacer, the attachment of the extension to the spacer will provide for the back end of the third portion to extend further outward than the front end while providing for the front end of the second tier to be planar with the first tier.

Hence, the spacer provides for the third portion to be angularity attached to the second portion. This unique design and configuration provides for the flats, large letters, magazines, catalogs, or the like to proceed down the belt toward the turn-end of the belt's pathway by enabling the third portion to hold the items upright in order to prevent jamming, while the spacer provides an adequate amount of space to permit, and not block, the existing pusher finger on a conventional mail sorting apparatus to freely pass and push the items forward.

In an alternative embodiment, the second and third portions can be adapted to be retrofitted onto an existing gate of a conventional mail sorting apparatus. In this embodiment, the second portion or spacer would be attached to the existing gate via an attaching means. This attaching means can include, but not be limited to, adhesives, tapping holes in the conventional gate in order to enable for thread rods or screws to be threadably inserted into the tapped holes.

Accordingly, it is the object of the present invention, to provide a two tier gate device that is adapted to be removably secured to an existing flat and/or letter sorting machine.

It is another object of the present invention to provide a two tier gate device that will not only permit for the finger to successfully continue pushing or guiding the items, but will also enable flats, large letters, magazines, catalogs, and the like to travel on the existing mail sorting machine without rolling up or turning sideways.

Still a further object of the present invention is to provide a two tier gate device that will eliminate machine jamming while increasing productivity of mail sorting apparatuses.

Yet another object of the present invention is to provide for an adapter which can be retrofitted onto an existing gate to provide for the existing gate and adapter to be a two tier gate device that will eliminate machine jamming while increasing productivity of mail sorting apparatuses.

A final object of the present invention, to be specifically enumerated herein, is to provide a two tier gate device in accordance with the preceding objects, which will conform to conventional forms of manufacture, be of simple construction and easy to use so as to provide a device that would be economically feasible, long lasting and relatively trouble free in operation.

Although there have been many inventions related to mechanical mail and document sorting, none of the previous apparatuses address the problem of flats jamming the machine by adapting or modifying the existing machine. Neither have other inventions become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner, or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
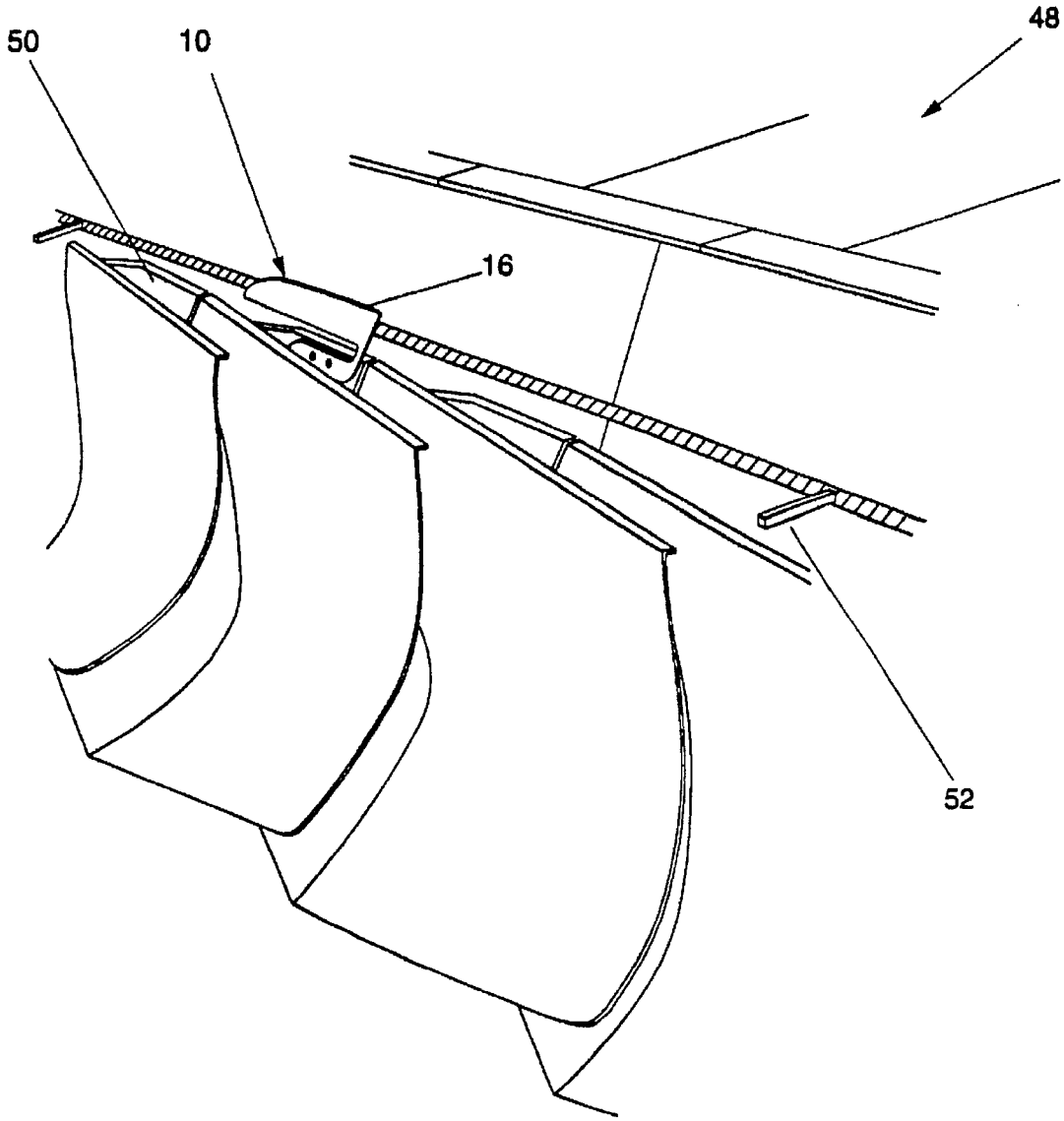
FIG. 1 is a partial perspective view of the two tier gate of the present invention attached to a conventional mail sorting apparatus.
Figure 2:
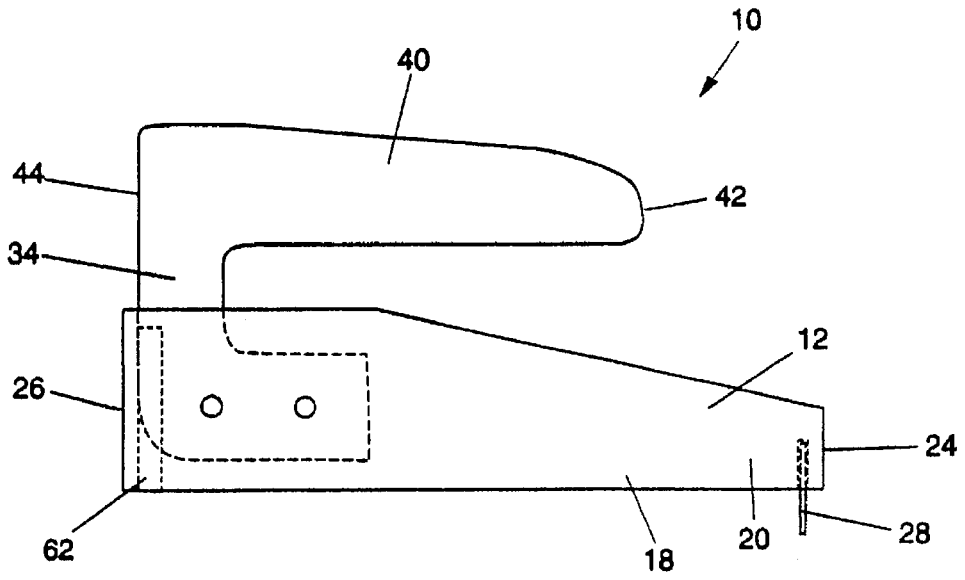
FIG. 2 is a front plan view of the two tier gate of the present invention.

FIGS. 1–6 illustrate the various views of the two tier gate device of the present invention. As seen in these figures, the two tier gate device 10 includes a first portion 12, a second portion 14, and a third portion 16.

The first portion 12 includes a first blade or first tier 18. This first blade or first tier 18 includes a front surface 20, a back surface 22, a front end 24 and a back end 26. Extending downwardly from the front end 24 of the first tier 18 is an attaching means 28. Extending downwardly from the back end 26 of the first portion 12 is a channel 62. The combination of the channel 62 and attaching means 28 enables the device to be removably secured to a conventional sorting machine 48 (see FIG. 1 for the illustration of the conventional sorting machine). Thereby, the attaching means 28 and the channel 62 provide for a securing means for the attachment of the two tier gate device 10 to a conventional mail sorting machine 48.

It is noted that FIG. 1 illustrates a Multiple Position Flat Sorting Machine (MPFSM) 775 or 881, which is a well known mail sorting apparatus. It is to be understood that the apparatus shown in FIG. 1 is only one example of a suitable mail sorting machine suited for use with the two tier gate device of the present invention, and it is further contemplated that appropriate modifications of the attaching means 28 and channel 62 of the two tier gate device 10 can be done in order for the device to be adapted to fit other mail sorting machines within the scope of skill of the ordinary artisan.

Figure 3:
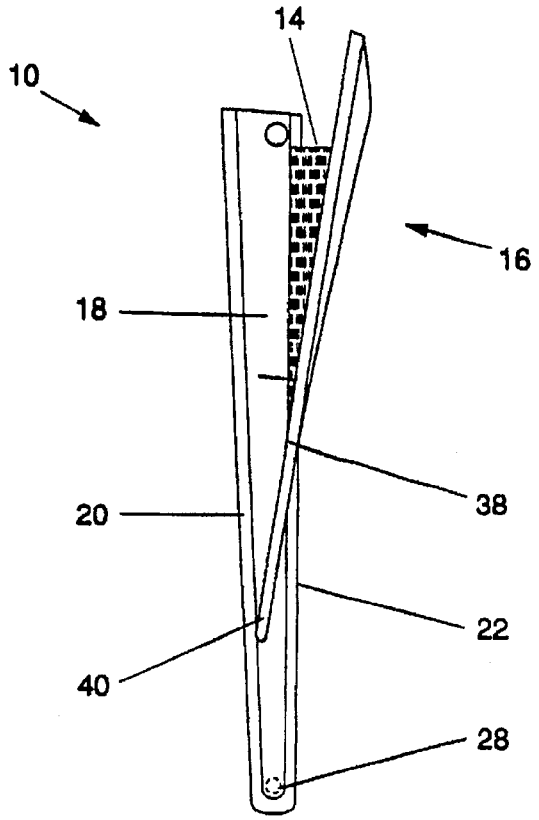
FIG. 3 is a back plan view of the two tier gate of the present invention.
Figure 4:
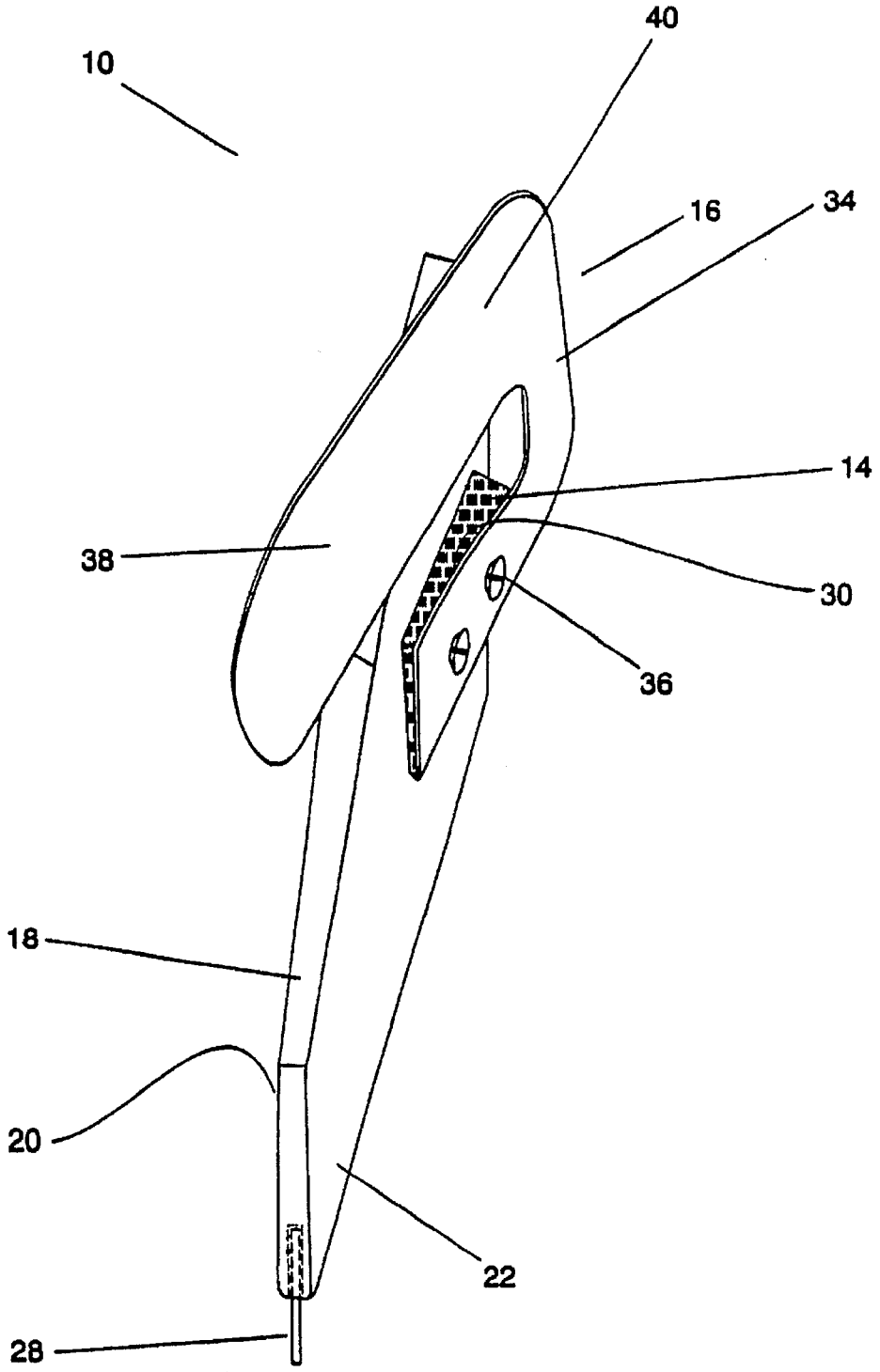
FIG. 4 is a perspective view of the two tier gate of the present invention.
Figure 5:
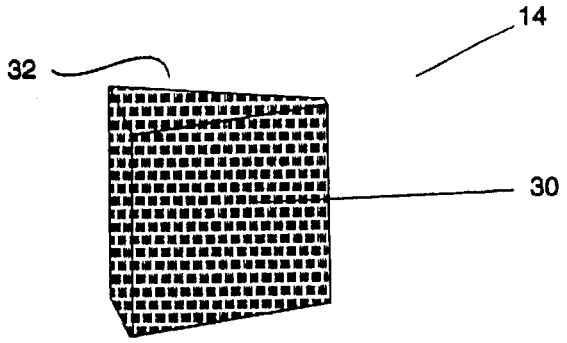
FIG. 5 is a top perspective view of the spacer or second portion of the two tier gate of the present invention.
Figure 6:
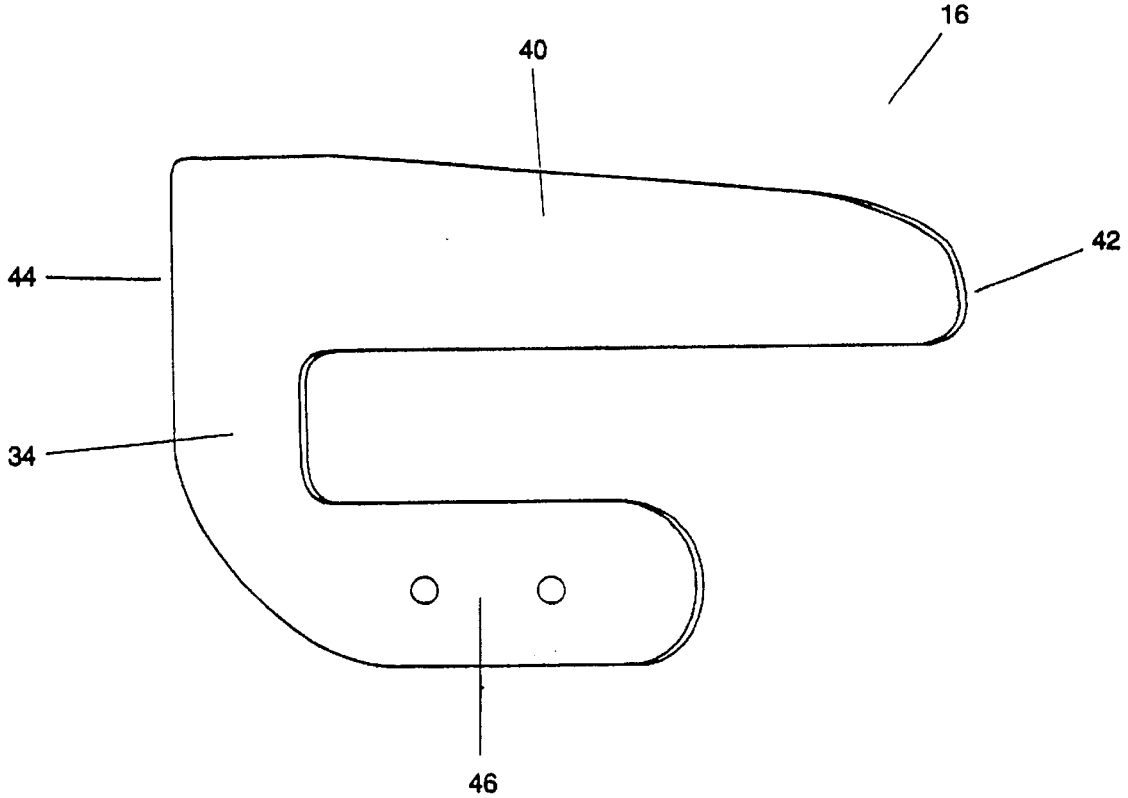
FIG. 6 is a side plan view of the third portion of the two tier gate of the present invention.

The second portion 14 of the two tier gate device is illustrated in FIGS. 3, 4 and 5. As seen in these figures, the second portion 14 is attached to the back surface 22 of the first tier 18. This second portion 14 acts as a spacer and includes a front surface 30 and a back surface 32. The back surface 32 of the second portion 14 is attached to the back surface 22 of the first tier 18. As illustrated, this back surface 32 is straight or planar. The front surface 30 of the second portion is angled with respect to the back surface 32. This will provide the spacer to have a top view of a right triangle or to have a horizontal cross section of a right triangle (see FIG. 3).

The third portion 16, which is illustrated in FIGS. 2–4, and 6, is attached to the front surface 30 of the second portion 14. The third portion 16 includes a shaft 34 having a top end and a bottom end. The top end of the shaft 34 is attached to a second blade or second tier 40. This second tier 40 is located above the first tier 18 and includes a front end 42 and a back end 44. This back end 44 of the second tier 40 is secured to the top end of the shaft 34.

The bottom end of the of the shaft 34 of the second portion 16 is attached to an extension 46. As seen, this extension 46 extends outwardly and perpendicularly with respect to the shaft 34. This will provide for the extension 46 to be planar and horizontal with the second tier or second blade 40. This extension is secured to the front surface 30 of the spacer 14, to provide for the entire length of the extension 46 to be attached to the front surface of the spacer via an attaching means 36, such as screws, bolts, or the like. This design and configuration will inherently provide for the front end 42 of the third portion 16 of the device 10 to be in a co-planar relationship with the first tier, while providing for the back end 44 of the second tier 40 and the shaft of the third portion to inherently be located outwardly from first tier. At the termination of the spacer, section 38, the second tier or blade 40 will cross over and above the back surface 22 of the first tier or blade 18. This will provide for the front end 42 of the second tier 40 to be co-planar with the first blade. Hence, the design and configuration provides for the second tier to maintain the flats, magazines, catalogs and the like in an upright position while still permitting for the fingers of the conventional mail sorting machine to pass the gate without any interference.

Accordingly, the second portion 14, the shaft 34 and extension 46 provide for an attaching means for the second tier to be secured to the first tier.

In order to utilize this two tier gate of the present invention (see FIG. 1), the conventional gate 50 is removed from the conventional machine 48. The two tier gate 10 of the present invention is secured to the conventional machine 48 via the attaching means. Once the two tier gate 10 is secured to the conventional machine 48, normal operation can occur. During the operation of the conventional machine, the flats, large letters, magazines, catalogues, and the like are pushed along a conveyer via a finger 52. If the item needs to be transferred to the appropriate bin, then the two tier gate 10 is pivoted. This will permit for the desired item be relocated to the appropriate bin. If the bin of the particular gate is not desired, then the gate is not pivoted and the items are continued on the conveyer via the finger 52.

To reduce the cost of producing and replacing the existing gates on a conventional mail sorting apparatus, the existing gate can be modified to enable the attachment of an adapter to provide for a two tier gate. This adapter 54, illustrated in FIG. 7, includes the spacer 14 of the first embodiment and the third portion 16 of the first embodiment. This adapter is adapted to be secured to an existing or conventional gate 50 via an attachment means. It is noted that the conventional gate 50 is identical in shape and configuration as with the first portion of the first embodiment. Also, the design and configuration of the spacer 14 and third portion 16 of the second embodiment is identical as with the first embodiment. Hence the operation and functionality of the second embodiment is similar as with the operation and functionality of the first embodiment.

The securing means of the second embodiment to the conventional gate 50 can include a plurality of well known attaching means such as the use of adhesives or as illustrated the use of threaded rods or screws.

Figure 7:
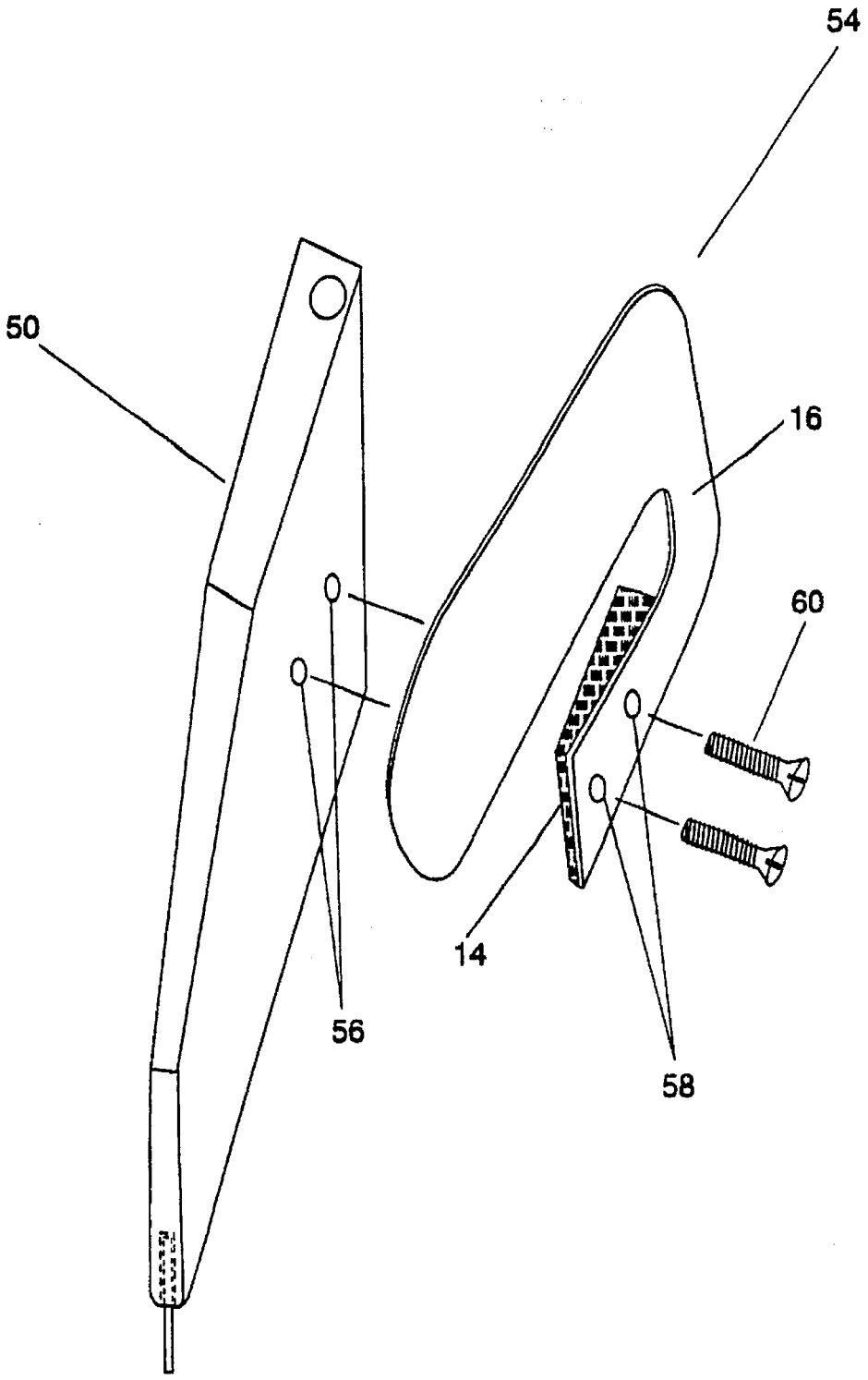
FIG. 7 is a perspective view of the second embodiment of the extension of the present invention prior to the attachment of the second embodiment to an existing gate in order to provide for the existing gate to become a two tier gate.

If an adhesive is not used, then as seen in FIG. 7, the existing gate can be altered by provide a plurality holes 56 to be formed in the gate 50. These holes can be tapped to provide for the holes to be internally threaded. A plurality of holes 58 are also provided in the adapter to provide for the holes 58 to extend into the extension and spacer. These holes 58 can be tapped to provide for the adapter 54 to include a plurality of internally threaded holes. The holes 56 in the conventional gate 50 and the holes 58 in the adapter 54 are adapted to be aligned with each other. Once these holes are aligned, a threaded rod, screw 60 or the like can be inserted into the holes to provide for the adapted to be secured to the conventional gate. Hence providing for a two tier gate device.

This altered gate operates and functions the same as the gate of the first embodiment.

While the invention has been particularly shown and described with reference to an embodiment thereof, it will be understood by those skilled in the art that various changes in form and detail may be made without departing from the spirit and scope of the invention.

I claim:

1. A two tier gate device that is to be used in combination with a conventional mail sorting machine, said two tier gate device comprising:

a first tier having a front surface and a back surface;

a securing means is attached to said first tier for enabling said first tier to be secured to said conventional mail sorting machine;

said first tier and said securing means constitute a first portion;

a second tier is secured above and to said first tier via an attaching means and said second tier includes a front end and a back end;

said attaching means includes a second portion and a third portion;

said second portion is secured to said first tier and said third portion is secured to said second portion and said second tier for coupling said second tier to said second portion, said third portion provides for said second tier to be located above said first tier;

said second portion provides for said second end of said second tier to be co-planar with said first tier and said first end of said second tier is off set with said first tier.

2. A two tier gate as in claim 1 wherein said second portion includes a spacer and said second portion includes a shaft and an extension;

said spacer has a back surface which is planar and is secured to said back surface of said first tier;

said spacer has a front surface which extends from a first end of said back surface of said spacer at an acute angle with respect to said back surface of said spacer to provide for said spacer to have a horizontal cross section of a right triangle and said front surface of said spacer is attached to said extension to provide for an entire length of said extension to be secured to said front surface of said spacer;

said extension is attached to a bottom end of said shaft and said extension extends outwardly and perpendicularly from said shaft;

a top end of said shaft is secured to said second tier; and said shaft connects said extension to said second tier.

3. An adapter to be used in combination with a gate on a conventional mail sorting machine to provide for a two tier gate where said gate is a first tier and constitutes a first portion, said adapter comprising:

a second tier is secured above and to said first tier via an attaching means and said second tier includes a front end and a back end; and said attaching means includes a second portion and a third portion;

said second portion is secured to said first tier and said third portion is secured to said second portion and said second tier for coupling said second tier to said second portion, said third portion provides for said second tier to be located above said first tier;

said second portion provides for said second end of said second tier to be co-planar with said first tier and said first end of said second tier is off set with said first tier.

4. An adapter as in claim 3 wherein said second portion includes a spacer and said second portion includes a shaft and an extension;

said spacer has a back surface which is planar and is secured to said back surface of said first tier;

said spacer has a front surface which extends from a first end of said back surface of said spacer at an acute angle with respect to said back surface of said spacer to provide for said spacer to have a horizontal cross section of a right triangle and said front surface of said spacer is attached to said extension to provide for an entire length of said extension to be secured to said front surface of said spacer;

said extension is attached to a bottom end of said shaft and said extension extends outwardly and perpendicularly from said shaft;

a top end of said shaft is secured to said second tier; and said shaft connects said extension to said second tier.

5. An adapter as in claim 4 wherein said securing means is an adhesive to provide for said adapter to be secured to said first tier via said adhesive.

6. An adapter as in claim 3 wherein said second portion includes a spacer and said second portion includes a shaft and an extension;

said spacer has a back surface which is planar and is secured to a back surface of said first tier;

said spacer has a front surface which extends from a first end of said back surface of said spacer at an acute angle with respect to said back surface of said spacer to provide for said spacer to have a horizontal cross section of a right triangle and said front surface of said spacer is attached to said extension to provide for an entire length of said extension to be secured to said front surface of said spacer;

said extension is attached to a bottom end of said shaft and said extension extends outwardly and perpendicularly from said shaft;

a top end of said shaft is secured to said second tier;

said shaft connects said extension to said second tier;

said first tier is tapped to provide for a first set of threaded through holes;

a second set of threaded through holes extend through said spacer and said extension;

said first set of threaded through holes are adapted to align with said second set of threaded through holes; and a plurality of threaded rods are received in said first set of threaded through and said second set of threaded through holes to provide for said adapted to be secured to said conventional gate via said first threaded through holes, said second threaded through holes, and said plurality of threaded rods.

* * * * *